US008827772B2

(12) United States Patent
Worthington

(10) Patent No.: US 8,827,772 B2
(45) Date of Patent: Sep. 9, 2014

(54) RAZOR SHARPENING SYSTEM

(75) Inventor: S. Nicholas Worthington, Santa Barbara, CA (US)

(73) Assignee: Lingua Franca Enterprises, LLC, Santa Barbara, CA (US)

( * ) Notice: Subject to any disclaimer, the term of this patent is extended or adjusted under 35 U.S.C. 154(b) by 296 days.

(21) Appl. No.: 13/413,582

(22) Filed: Mar. 6, 2012

(65) Prior Publication Data

US 2013/0237134 A1 Sep. 12, 2013

(51) Int. Cl.
*B24B 3/48* (2006.01)

(52) U.S. Cl.
USPC ..... 451/45; 451/58; 451/65; 451/163; 451/164; 451/371; 30/35; 76/81.7; 76/DIG. 9

(58) Field of Classification Search
USPC ..... 451/45, 57, 58, 65, 66, 163, 164, 169, 451/349, 367, 371, 463; 30/35, 36, 37, 38; 76/81.7, DIG. 9
See application file for complete search history.

(56) References Cited

U.S. PATENT DOCUMENTS

| | | | | |
|---|---|---|---|---|
| 2,043,957 | A * | 6/1936 | De Haven | 451/540 |
| 3,854,251 | A * | 12/1974 | Paule | 451/321 |
| 3,875,702 | A * | 4/1975 | Yacos | 451/163 |
| 3,979,857 | A * | 9/1976 | Kobylarz | 451/293 |
| 4,122,602 | A | 10/1978 | Sastri et al. | |
| 4,615,436 | A | 10/1986 | Hastie | |
| 5,139,138 | A * | 8/1992 | Isaksen | 206/228 |
| 6,506,106 | B2 * | 1/2003 | Fletcher | 451/293 |
| 7,104,874 | B1 * | 9/2006 | Gussack et al. | 451/234 |
| 7,134,935 | B1 * | 11/2006 | Papetti | 451/10 |
| 7,547,244 | B2 * | 6/2009 | Fletcher | 451/8 |
| 8,033,894 | B2 * | 10/2011 | Yadid et al. | 451/45 |
| 8,074,535 | B2 * | 12/2011 | Martell | 76/82 |
| 2002/0164935 | A1 * | 11/2002 | Fletcher | 451/293 |
| 2004/0098862 | A1 | 5/2004 | Orloff | |
| 2005/0101231 | A1 * | 5/2005 | Sekerich | 451/234 |
| 2007/0074603 | A1 | 4/2007 | Gherman et al. | |
| 2008/0098603 | A1 | 5/2008 | Noble et al. | |
| 2008/0248731 | A1 * | 10/2008 | Fletcher | 451/164 |
| 2010/0068975 | A1 * | 3/2010 | Yadid et al. | 451/45 |
| 2010/0223792 | A1 * | 9/2010 | Martell | 30/35 |
| 2011/0081838 | A1 * | 4/2011 | Bagley et al. | 451/45 |
| 2012/0103139 | A1 * | 5/2012 | Martell | 76/82 |

FOREIGN PATENT DOCUMENTS

| | | |
|---|---|---|
| EP | 2080597 A2 | 7/2009 |

* cited by examiner

*Primary Examiner* — Eileen P. Morgan
(74) *Attorney, Agent, or Firm* — Felix L. Fischer

(57) ABSTRACT

A shaving system includes a razor having a handle and a safety housing with a blade extendably received within the safety housing. An integrated sharpening system incorporates an armature receiving the razor, the armature being movable from a first position for attachment and extraction of the razor and a second position for sharpening of the blade. A sharpening mandrel is provided with a first sharpening surface for sharpening a first side of the blade and a second surface for sharpening of a second side of the blade. The sharpening mandrel is rotatable from a first position for engagement of the first sharpening surface to a second position for engagement of the second sharpening surface. The sharpening mandrel is laterally oscillated for sharpening of the blade. A controller is provided for positioning of the armature and sharpening mandrel.

16 Claims, 17 Drawing Sheets

RAZOR SHARPENING SYSTEM

BACKGROUND INFORMATION

1. Field

Embodiments of the disclosure relate generally to the field of shaving razors and more particularly to a system incorporating a razor with an extendible blade received within an automated sharpening system having a blade extension armature, a reciprocating sharpening mandrel rotatable between two positions for sharpening both sides of the blade, a positioning sensor system, an ultraviolet disinfecting element and a magnetic blade polarization system.

2. Background

Shaving of facial and body hair is undertaken by both men and women to various degrees. Initially shaving was accomplished using a straight razor. However, the relative skill required to avoid cutting the skin during shaving made the straight razor an unattractive tool. Various devices including the safety razor and modern removable/replaceable/disposable head razor cartridges with multiple blades or entirely disposable razors have been invented to reduce the hazards of shaving while providing a reasonably safe and comfortable shave.

However, the advantages of the straight razor including the a rigid high quality steel construction for maintaining a sharp edge for an extremely clean and close shave, and the ability to resharpen the edge continuing long term use have not been duplicated in modern razor systems. Further, disposable razors are wasteful of both economic and natural resources and are by definition engineered to be operationally obsolescent within weeks if not days.

It is therefore desirable to provide a razor and sharpening system which maintains the efficiency and safety of modern disposable razor systems but also provides a higher quality shave with a long life reusable system.

SUMMARY

Embodiments disclosed herein provide a shaving system which includes a razor having a handle and a safety housing with a blade extendably received within the safety housing?. An integrated sharpening system incorporates an armature receiving the razor, the armature being movable from a first position for attachment and extraction of the razor and a second position for sharpening of the blade. A sharpening mandrel is provided with a first sharpening surface for sharpening a first side of the blade and a second surface for sharpening of a second side of the blade. The sharpening mandrel is rotatable from a first position for engagement of the first sharpening surface to a second position for engagement of the second sharpening surface. The sharpening mandrel is laterally oscillated for sharpening of the blade. A controller is provided for positioning of the armature and sharpening mandrel.

The shaving system allows a method for sharpening a razor which is accomplished by engaging a razor having a blade extendibly mounted in a safety housing in an integrated sharpening system. The blade is then extended and a sharpening mandrel is rotated to a first position for engagement of a first side of the blade. The sharpening mandrel is then oscillated to hone the first side of the blade. The sharpening mandrel is then rotated to a second position for engagement of the opposite second side of the blade and oscillated to hone the second side of the blade. The blade is then retracted and the razor is disengaged from the integrated sharpening system.

The features, functions, and advantages that have been discussed can be achieved independently in various embodiments of the present disclosure or may be combined in yet other embodiments further details of which can be seen with reference to the following description and drawings.

DETAILED DESCRIPTION

Embodiments disclosed herein provide a razor carrying a high quality steel blade which is extendible from a safety housing for sharpening. An integrated sharpening system in an enclosure receiving the razor provides a blade extension armature for positioning the razor and/or blade, a reciprocating sharpening mandrel rotatable between two positions for sharpening both sides of the blade, a proximity sensor positioning system an ultraviolet disinfecting element and a magnetic blade polarization system with an internal controller for automated sharpening and preparation of the razor for use.

Figure 1:
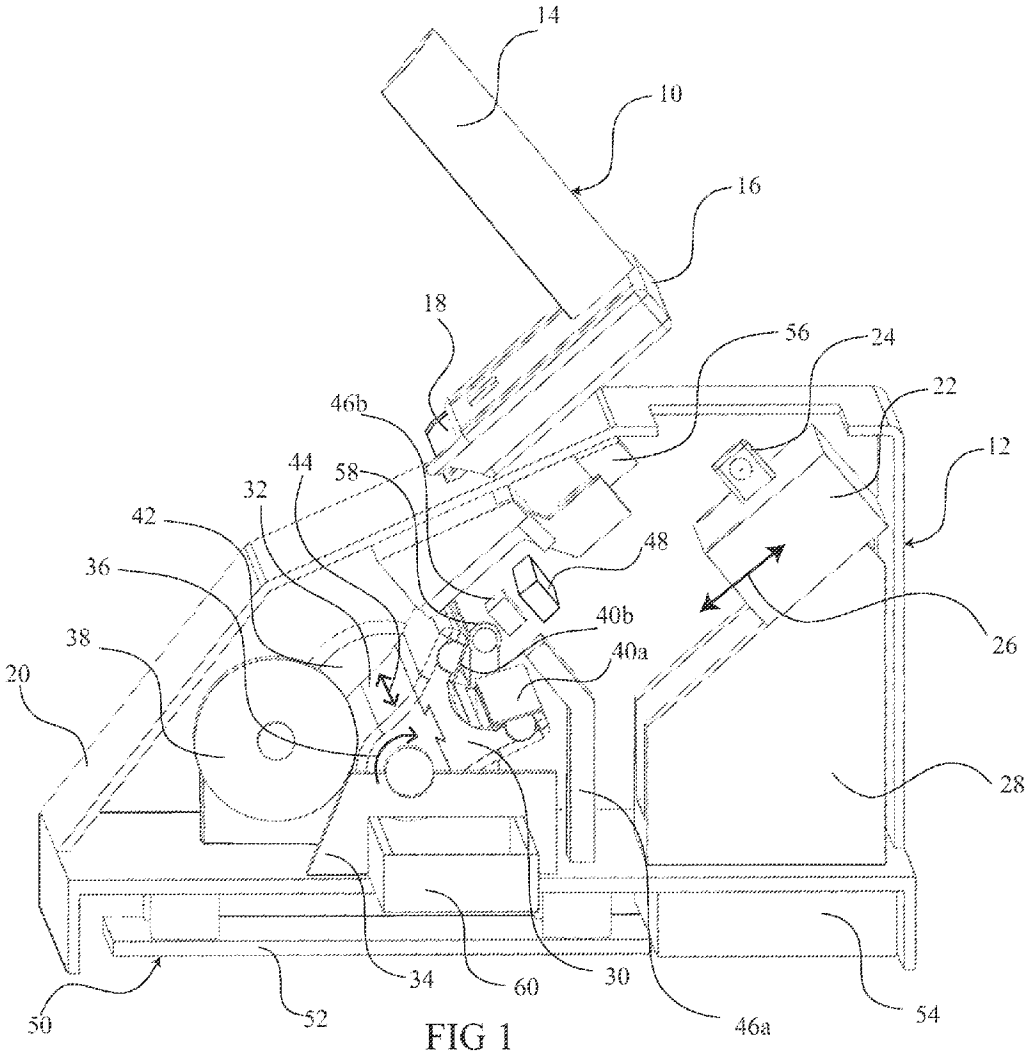
FIG. 1 is a perspective partial section side view of a first embodiment of the razor and integrated sharpening system.
Figure 4A:
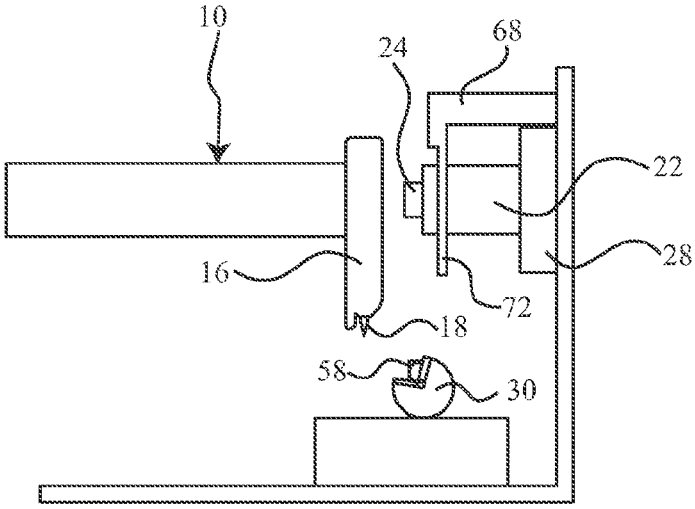
FIGS. 4A-4E are simplified schematic representations of the operating components of the embodiment of FIG. 1 showing the sequence of operation for blade sharpening.

Referring to the drawings, FIG. 1 shows a first exemplary embodiment for a razor 10 and integrated sharpening system 12. The razor 10 employs a handle 14 which carries a safety housing 16 enclosing a blade 18 which is extendible from the housing. The integrated sharpening system 12 is housed in a case 20 A blade extension armature 22, which removably receives the razor housing and blade on an engagement post 24, is movable from a first position (shown) for insertion of the razor to a second adjustable position for sharpening of the blade indicated by arrow 26 (as will be described in greater detail with respect to FIGS. 4A-4C). A translation motor 28 supports the blade extension armature 22 and provides the desired reciprocating motion.

Contained within the case 20 is a sharpening mandrel 30 which is removably carried by a mandrel holder 32. The holder is supported on saddles 34 (shown in greater detail in FIG. 2) for rotation, represented by arrow 36, about a longitudinal axis by a mandrel rotation motor 38. The sharpening mandrel 30 incorporates two sharpening surfaces which for the embodiment shown are two sharpening pads 40*a* and 40*b* on angularly displaced faces which are positioned for sharpening of opposing sides of the blade 18 of the razor through the rotation of the sharpening mandrel. For an example embodiment, the sharpening pads are an injection molded plastic with a thin coating of Cubic Boron Nitride (CBN) dust or diamond dust bonded to its surface to act as a sharpening media. The estimated size of the sharpening dust particles will be between 0.25-2 microns in size. For the embodiment shown, the open angular segment of the mandrel subtends approximately 75° of arc. An oscillating motor 42 attached to the mandrel holder 32 provides lateral oscillation of the sharpening mandrel 30 and associated sharpening pads 40*a* and 40*b* as indicated by arrow 44. In the example embodiment, a voice coil motor is employed but alternative motor types may be used in other embodiments.

While described with respect to the drawings as sharpening pads with abrasive surfaces, the pads may also employ materials for stropping the blade to provide blade alignment and sharpness without actual removal of material as in sharpening. In alternative embodiments, the sharpening pads, 40*a* and 40*b* may be replaceable with interchangeable abrasive and stropping elements.

An ultraviolet (UV) lighting system having a lower head 46*a* and an upper head 46*b* is provided in the case as a sanitizing element. The heads are positioned such that the extended blade 18 and end portion of the safety housing 16 passes between the lower and upper head exposing all contact points on the razor to the UV light for optimal elimination of microbial contaminants. An electromagnet 48 positioned in the case adjacent the extended blade enhances corrosion resistance by alignment of the metal ions in a plane of the shaving edge of the blade with an electromagnetic field after the sharpening cycle as described subsequently.

Control of the integrated sharpening system is accomplished with a controller 50 which may incorporate a microprocessor or other control logic and associated control circuitry on a printed circuit board 52 mounted within the case. Power for the motors and controller is provided by a battery 54. Associated with the controller 50 is a Radio Frequency identification (RFID) reader 56 which is positioned in the case 20 to read an RFID tag associated with each razor housing 16. Identification of the razor being sharpened allows the controller to specifically tailor the sharpening operation to that razor blade taking into account age and wear and may also provide the ability to notify the user when the useful life of a blade has been exceeded based on stored data as well as track product warranty related usage proximity sensor positioning system 58, which may employ a photo cell "detection eye", other optical sensor, a capacitive or inductive position sensor, is connected to the controller 50 and positioned adjacent the sharpening mandrel 30 for precise location of the edge of the blade 18 for accurate positioning and sharpening. Measurements by the proximity sensor positioning system of the blade position/length prior to sharpening and after sharpening may be stored by the controller for use in blade wear data cataloging. A second proximity sensor positioning system may also be used to accurately reposition the razor blade relative to the to safety housing 16 account for blade wear caused by sharpening.

A removable debris catch tray 60 is positioned in the case 20 under the sharpening mandrel to catch and retain debris such as hair and grinding dust accumulated from sharpening of the blades. Slots in the sharpening mandrel 30 allow metal debris to fall into the tray 60. The case 20 includes a frame providing the mounting features required to securely fasten all internal components with accuracy. This sub-frame may be made from injection molded ABS plastic or die cast zinc material.

Figure 3A:
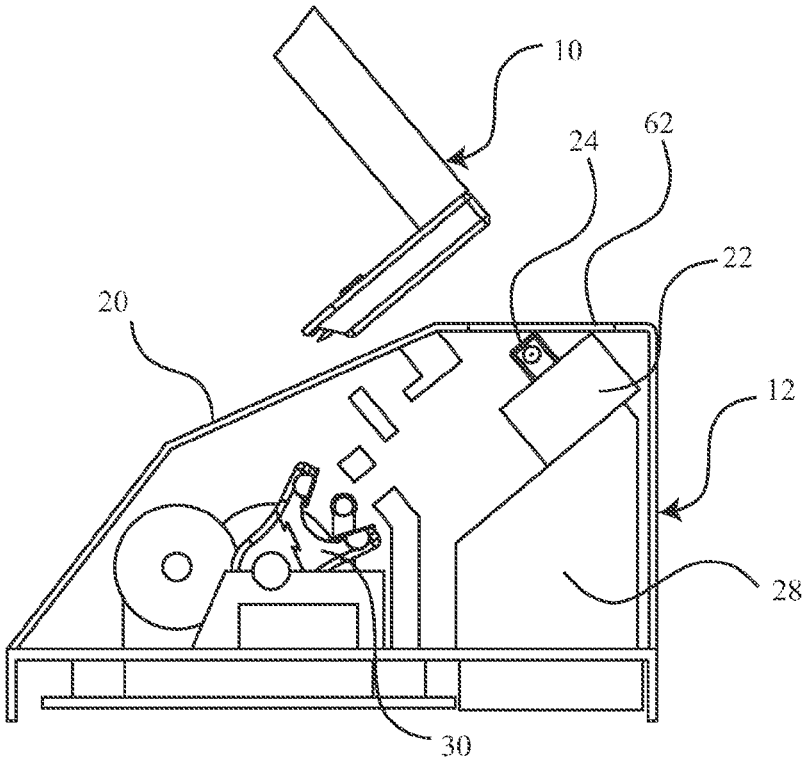
FIGS. 3A and 3B are side section views of the embodiment of FIG. 1 with the razor in preparation for insertion and inserted into the integrated sharpening system.
Figure 3B:
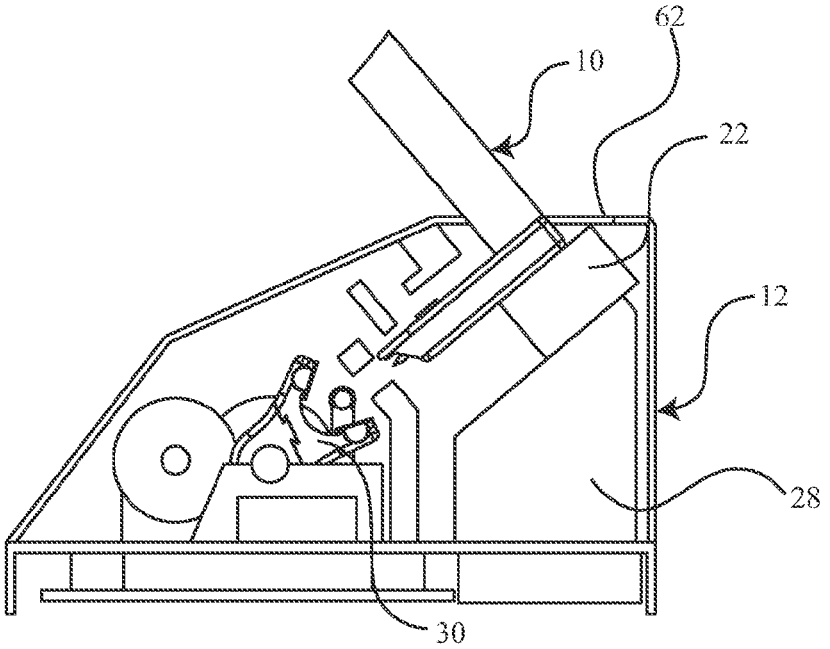
Figure 4B:
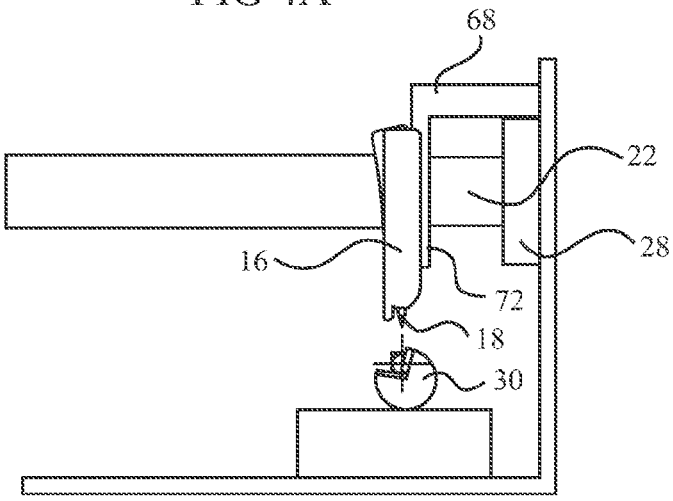
Figure 4C:
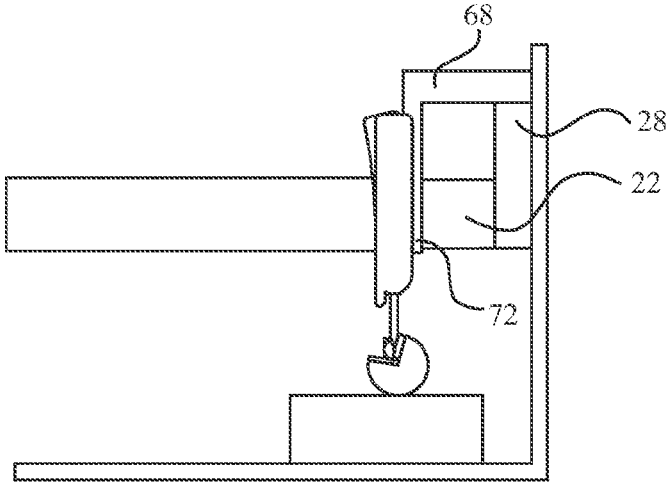
Figure 4D:
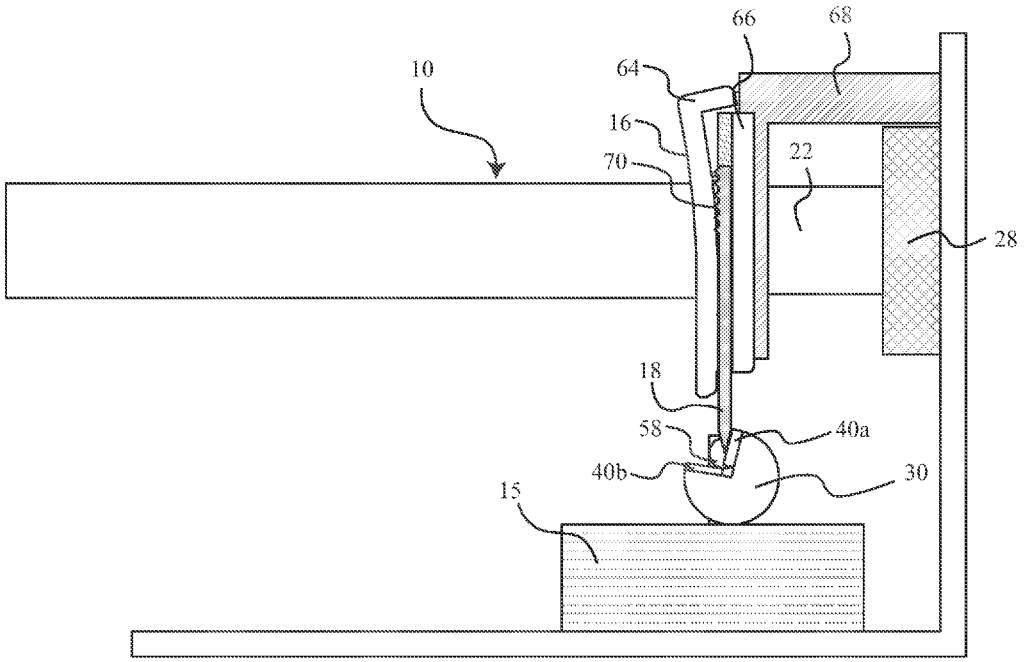
Figure 4E:
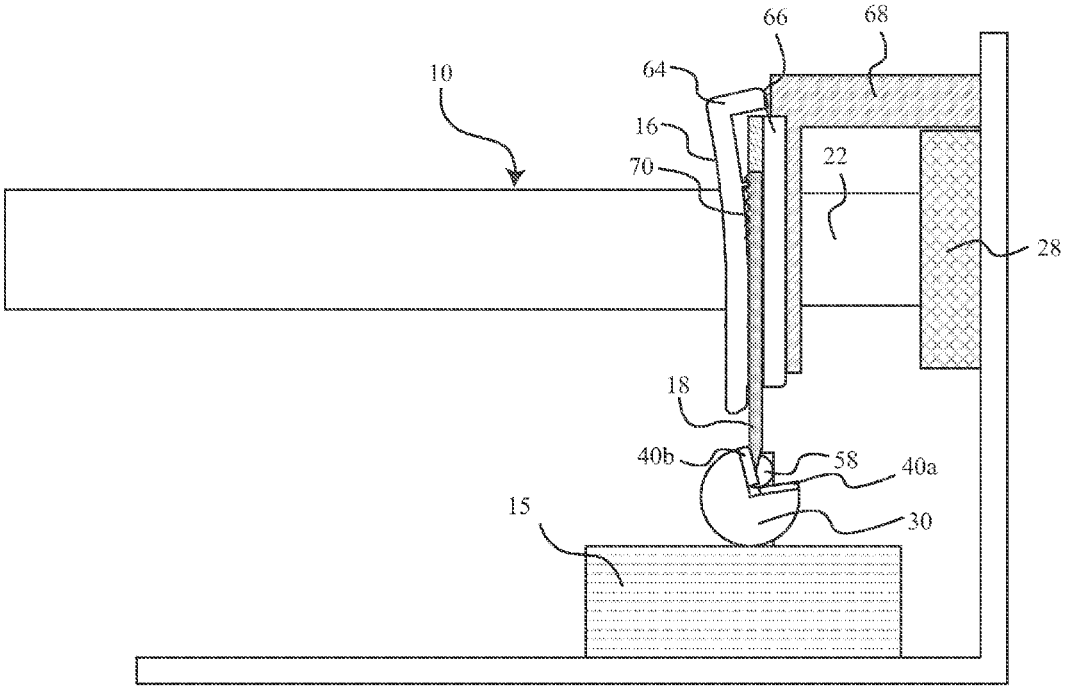

As shown in FIGS. 3A and 3B, the safety housing 16 of the razor 10 is inserted through aperture 62 to be received on engagement post 24. For the embodiment shown the engagement post employs a spring loaded detent ball to engage a receiving cavity on the blade 18 in the safety housing 16 of the razor 10. In the inserted position as shown in FIG. 3B, the razor is then ready for the sharpening operation. As shown in simplified schematic form for the first embodiment in FIGS. 4A-4D, the razor is aligned with the engagement post 24 (FIG. 4A) and pressed onto the post (FIG. 4B). For this embodiment of the razor safety housing and blade the blade 18 is frictionally engaged between resilient back elements 64 and a front plate 66 of the housing 16 (as best seen in FIG. 4D). Engagement arms 68 are received through slots in the front plate and, when the razor safety housing 16 is urged onto the engagement post 24, urge the resilient back element away from the rear surface of the blade 18 releasing the frictional engagement of the blade in the housing. An array of spaced ridges or dimples 70 may be employed to enhance the frictional engagement to additionally secure the blade and to provide fixed increments for length positioning of the blade upon reinsertion into the housing.

The safety housing for various embodiments may be made from injection molded Acrylonitrile-Butadiene-Styrene (ABS) plastic or Die Cast aluminum with an anodized finish. If made from aluminum the resilient back elements may be spring steel component to act as the locking feature for the guard. If made from plastic the resilient elements can be molded directly into the part as a "living hinge" type design. For the example embodiment, the razor blade is a steel alloy in the 200 series with post hardening treatment to achieve a Rockwell hardness of approx. 58-62. The edge of the blade is sharpened to an included angle of 15 degrees. The blade will include the ridges 70 as a stamped feature. The thickness of the blade is between 0.035"-0.045"

Figure 2:
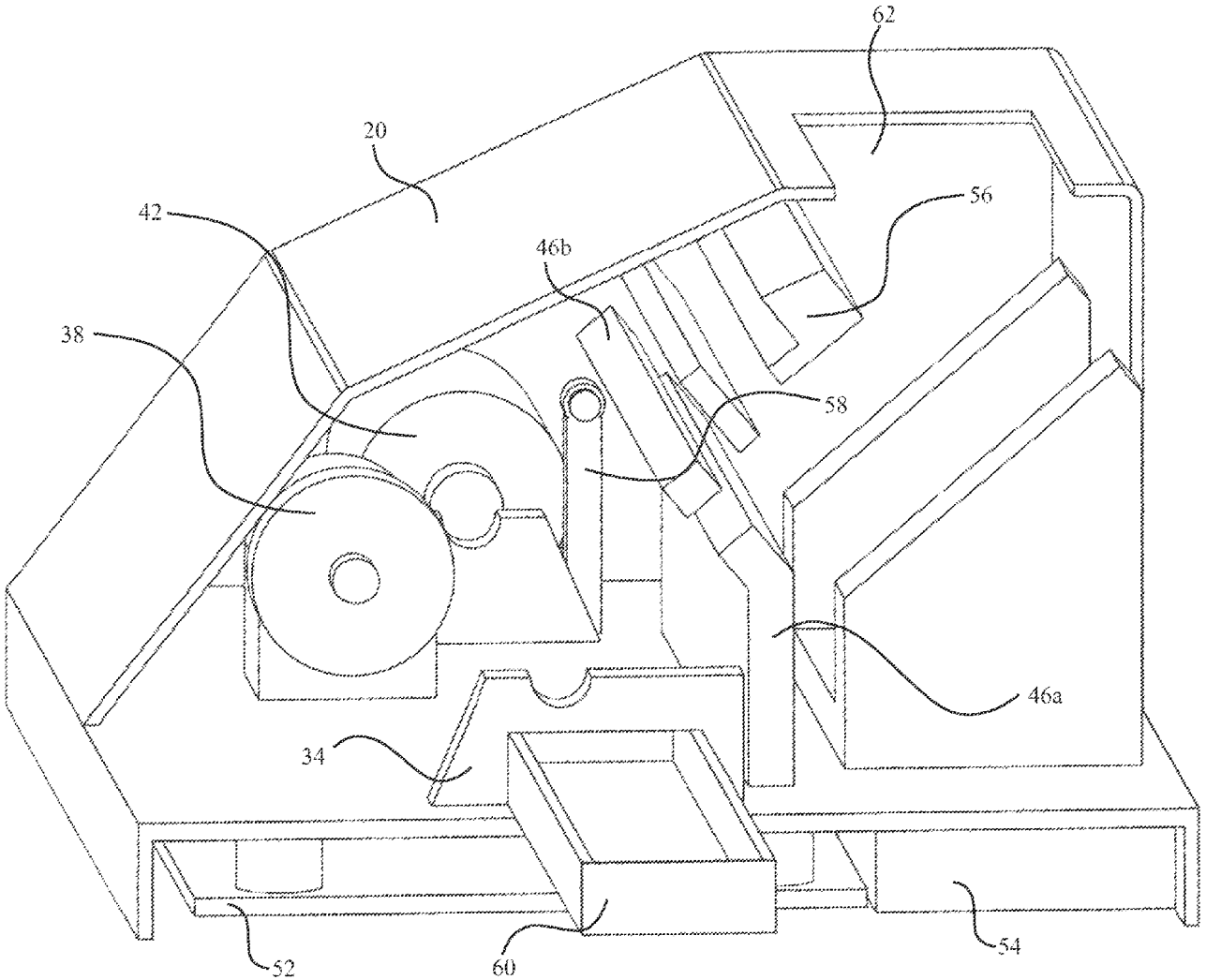
FIG. 2 is a perspective partial section side view of the embodiment of FIG. 1 with the sharpening mandrel and mandrel holder removed for display of remaining components.

Extension armature 22 is then translated downward by translation motor 28 extending the blade 18 which is secured by the engagement post 24. Depending securing elements 72 on the arms 68 (which are shown as smooth for mere frictional engagement but may be hooked or otherwise mating indexed to the front plate 66 of the housing) prevent downward translation of the housing. Translation motor 28 is controlled by the controller 50 to move the extension armature 22 for positioning of the blade 18 as determined by the proximity sensor positioning system 58. The blade edge is placed at a predetermined position for correct angular contact by the sharpening pad 40*a* on the sharpening mandrel 30 which has been angularly positioned by the mandrel rotation motor 38 (shown in FIGS. 1 and 2) for contact with the blade. The sharpening mandrel 30 is then reciprocated laterally along the blade edge by the by the oscillating motor 42 (as seen in FIGS. 1 and 2) honing a first side of the blade edge. The sharpening mandrel 30 is then rotated by the mandrel rotation motor 38 to angularly position the second sharpening pad 40*b* on an opposite contact plane with the blade. The sharpening mandrel 30 is then reciprocated laterally along the blade edge by the by the oscillating motor 42 honing a second side of the blade edge. Adjustment of the extended length of the blade between the honing of the two sides of the edge may be accomplished, if required, by the translation motor moving the extension armature as directed by the controller based on the blade location detected by the proximity sensor positioning system.

Upon completion of the sharpening process, the translation motor 28 moves the extension armature 22 upward to retract the blade 18 into the safety housing 16 with calculated alignment with the spaced array of dimples 70 for optimal shave angle of the blade relative to the housing. The translation motor 28 may be a stepper motor, piezo electric motor or similar precision motor allowing precise control by the controller for the retracted length to accommodate the overall length reduction in the blade due to the sharpening procedure. Removal of the razor from the engagement post 24 returns the resilient arms 64 into contact with the blade 18 to frictionally secure the blade within the safety housing 16. Additionally with use of a stepper motor or motor having similar accuracy as the mandrel rotation motor 38, the controller may adjust the rotation angles of the mandrel 30 in combination with the blade position using the translation motor 28 such that the blade is moved for spaced contact slightly outward on pads 40*a* and 40*b* from where the blade touched in the last sharpening session. Once the entire pad has been used, the logic resets the blade onto the inside portion of the sharpening pads 40*a* and 40*b* closest to the vertex of the mandrel and the sequence starts over again.

Figure 5A:
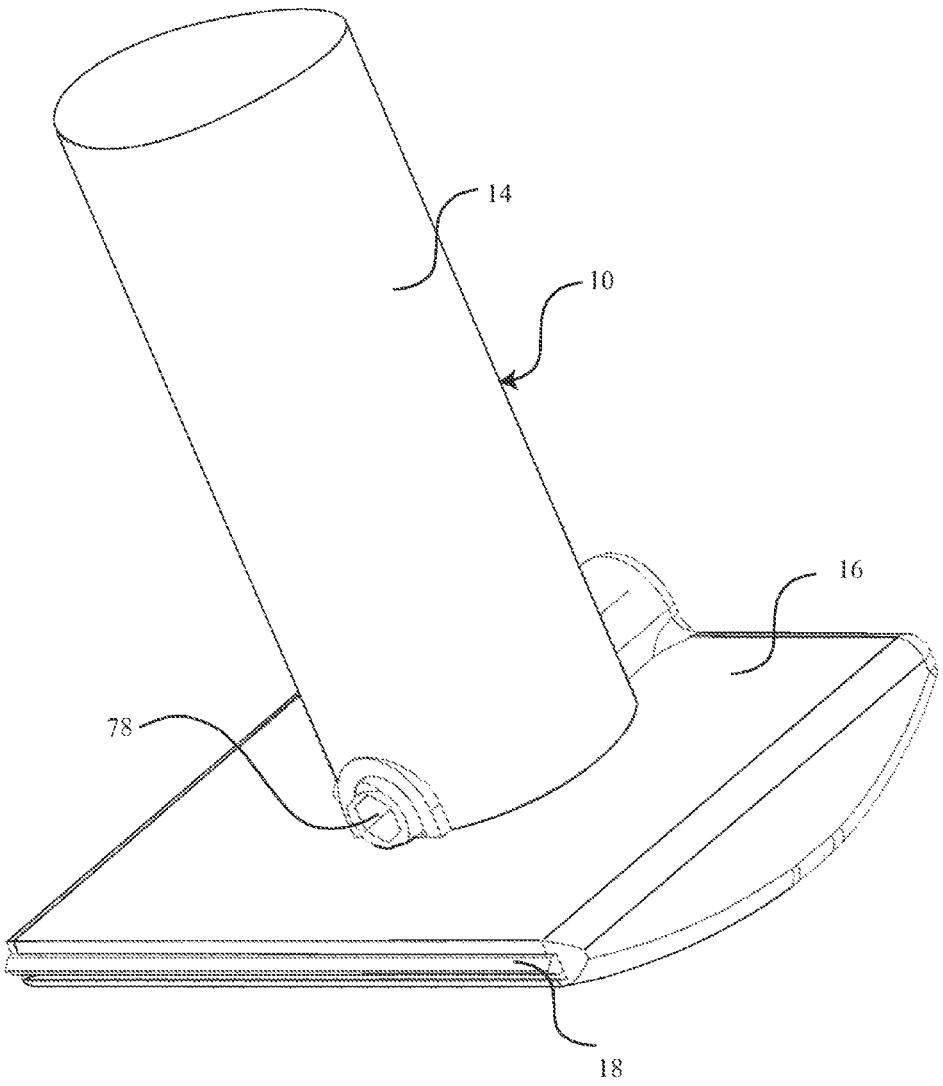
FIG. 5A is a perspective view of a second embodiment of the razor.
Figure 5B:
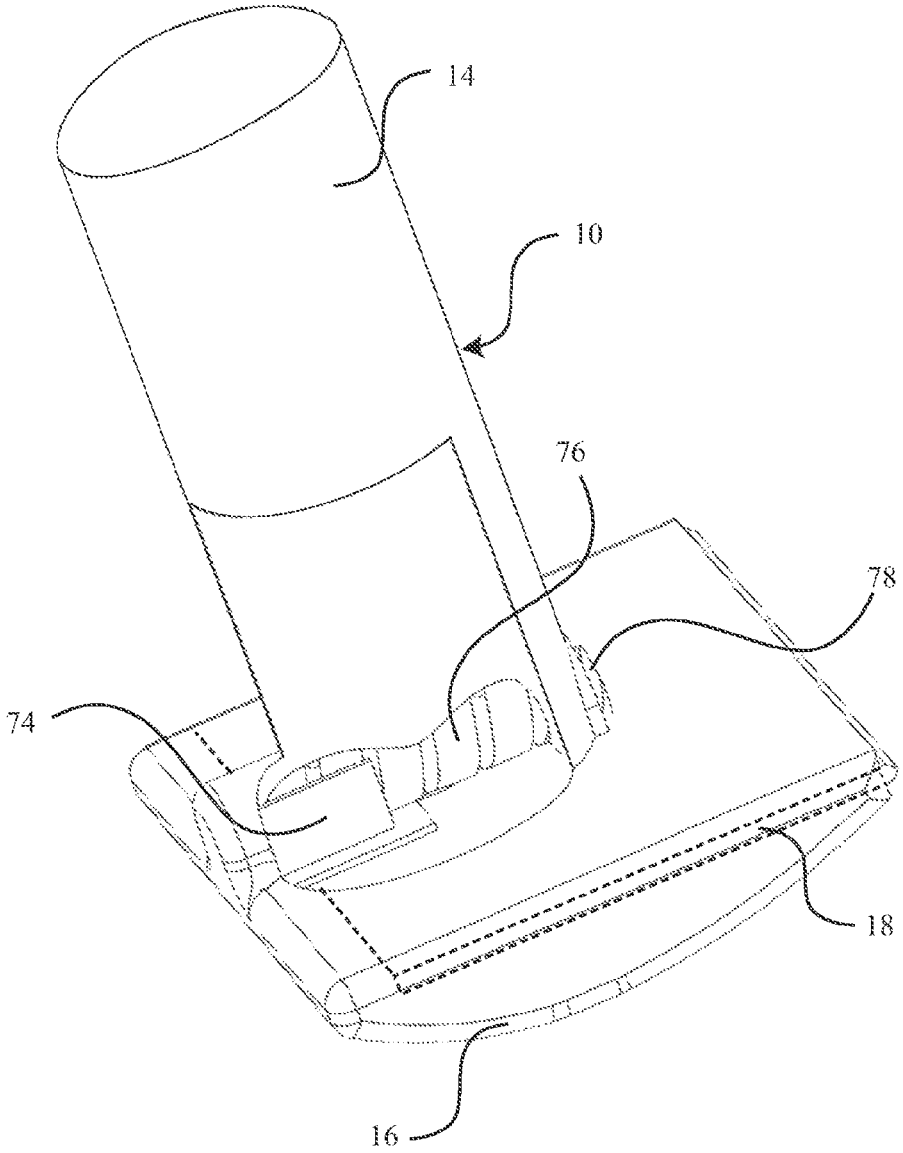
FIG. 5B is a perspective partial section view of the razor embodiment of FIG. 5A with the blade retracted.
Figure 5C:
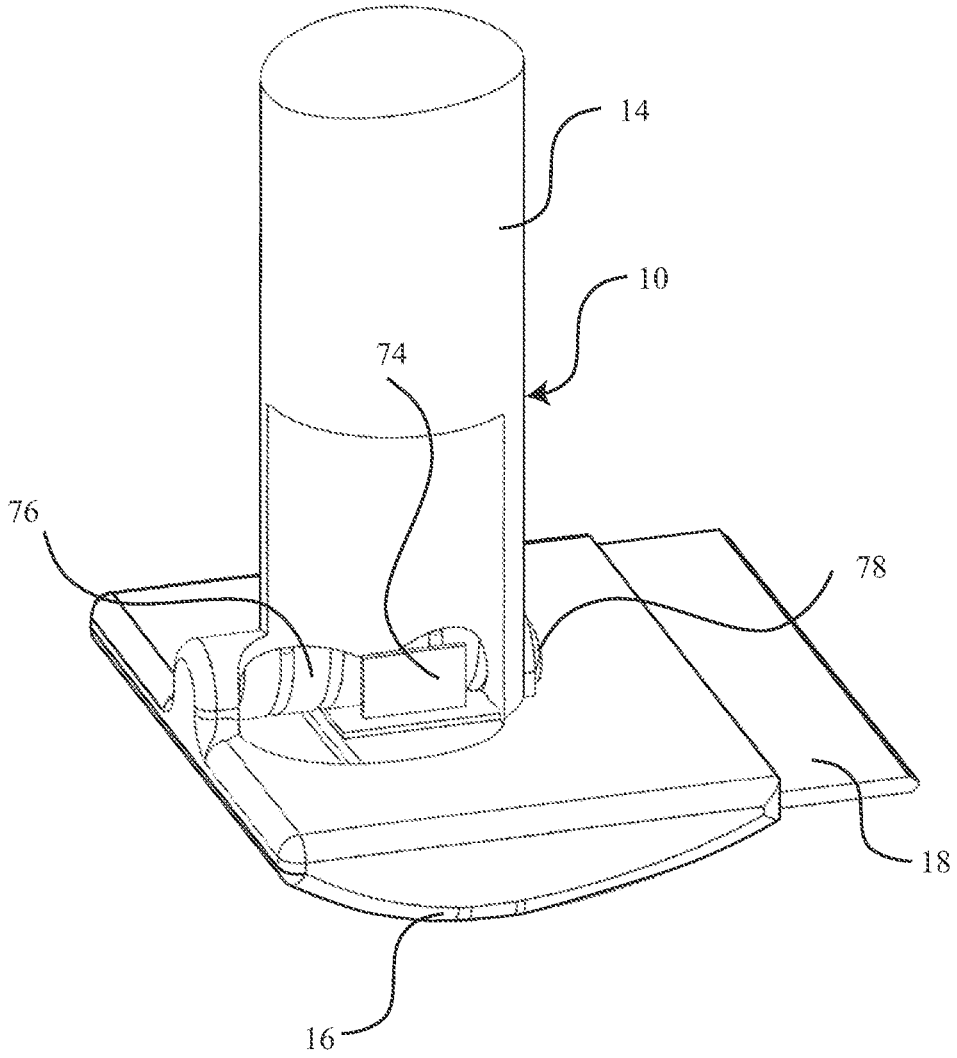
FIG. 5C is a perspective partial section view of the razor embodiment of FIG. 5A with the blade extended.

A second exemplary embodiment of the razor 10 is shown in FIGS. 5A through 5C. As with the first embodiment, the blade 18 is extendably retained with a safety housing 16. However, the blade 18 incorporates a tracking dolly 74 which is engaged by a jack screw 76. The screw 76 incorporates a hex bore 78 for drive engagement. Rotation of the screw 76 drives the tracking dolly 74 which extends or retracts the blade into the housing. In alternative embodiments, a gear rack machined into the upper surface of the blade 18 may engage the jack screw for extension and retraction of the blade.

Figure 6:
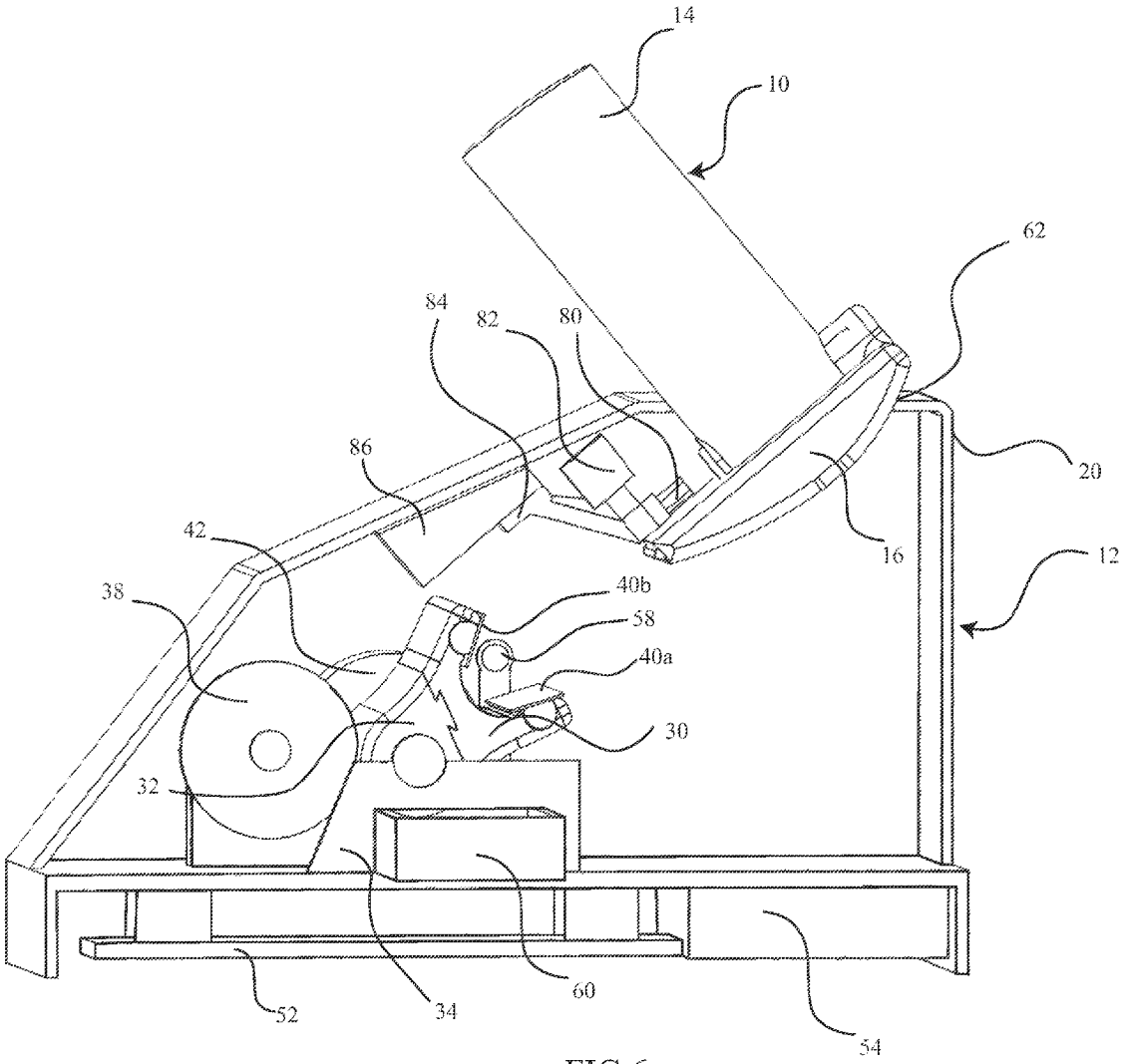
FIG. 6 is a perspective partial section side view of a second embodiment of the integrated sharpening system for use with the razor of FIGS. 5A and 5B.

A second exemplary embodiment of integrated sharpening system 20 to accommodate the razor second embodiment is shown in FIG. 6 with components in common with FIGS. 1-3C carrying the same element numbers. The razor 10 is inserted into the aperture 62 in case 20 and rotating engagement post 80 is received within the hex bore 78 which may incorporate a spring loaded detent ball to be received within a detent in the hex bore to secure the razor into the case. A drive motor 82 with appropriate drive train rotates the rotating engagement post 80 and the engagement post 80 with drive motor 82 and drive train are mounted to a translation armature 84. A translation motor 86 moves the translation armature 84 to position the safety housing 16 within the case as required by the controller 50. While not shown in FIG. 6, the UV lighting system, RFID reader and electromagnetic polarization system as described with respect to FIGS. 1 and 2 may be employed in the second embodiment.

Figure 7A:
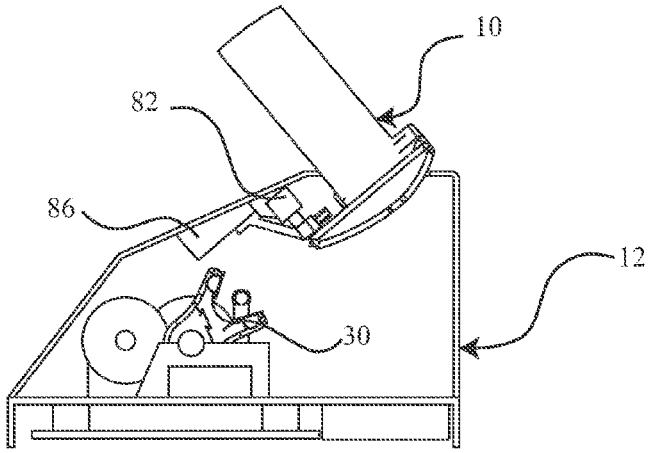
FIGS. 7A-7D are side section views of the operating components of the embodiment of FIG. 6 showing the sequence of operation for blade sharpening.
Figure 7B:
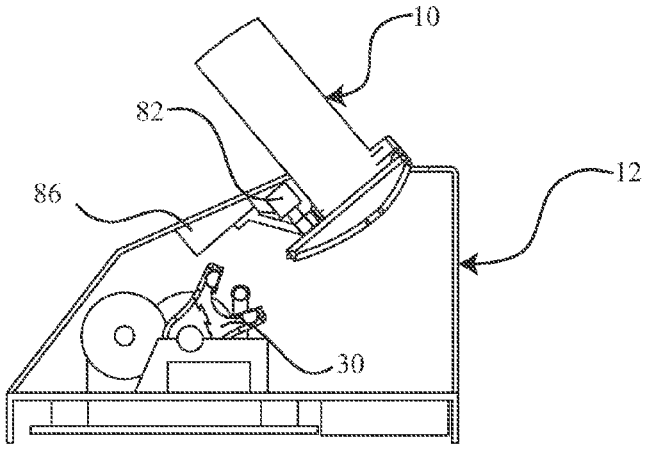
Figure 7C:
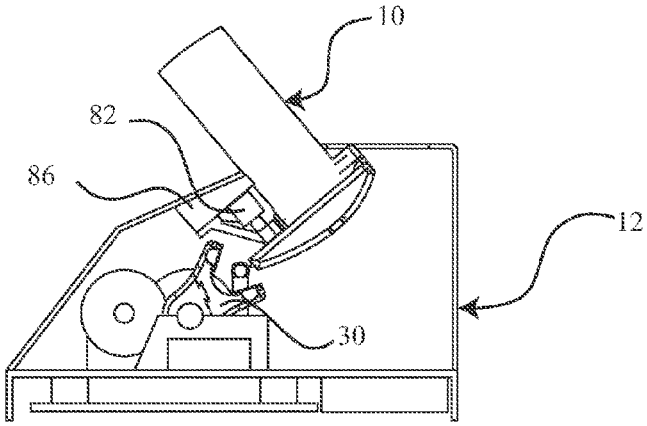
Figure 7D:
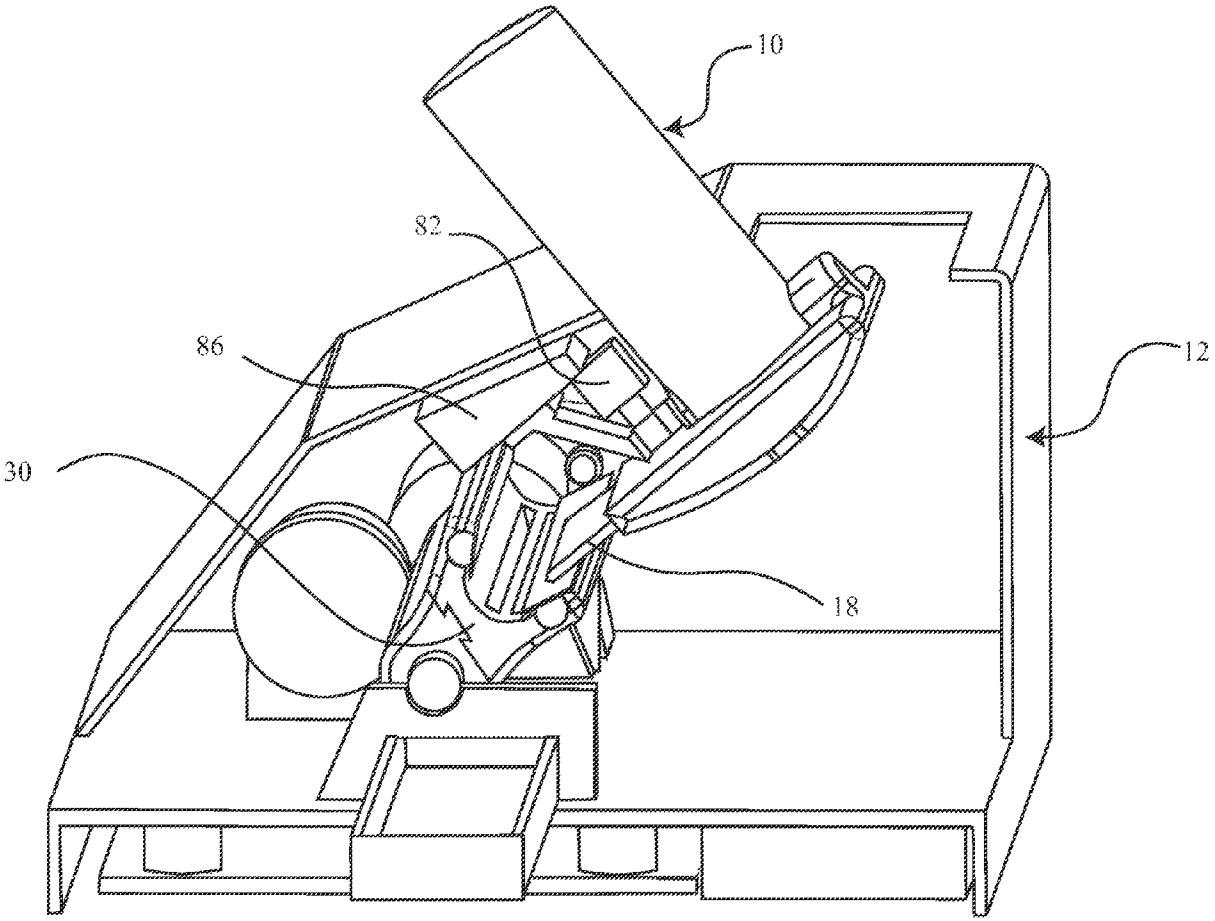

As shown in FIGS. 7A-7C, the safety housing 16 of the razor 10 is inserted through aperture 62 and hex bore 76 is aligned with the engagement post 80 (FIG. 7A) and pressed onto the post (FIG. 7B). Translation armature 84 is then translated downward by translation motor 86 (FIG. 7C). Drive motor 82 is then operated to rotate rotating engagement post 80 and 76 screw to drive gear rack 74 extending the blade 18 (FIG. 7D). Translation motor 86 and drive motor 82 are controlled by the controller 50 for positioning of the blade 18 as determined by the proximity sensor positioning system 58. The blade edge is placed at a predetermined position for correct angular contact by the sharpening pad 40*a* on the sharpening mandrel 30 which has been angularly positioned by the mandrel rotation motor 38 (shown in FIGS. 1 and 2) for contact with the blade. The sharpening mandrel 30 is then reciprocated laterally along the blade edge by the by the oscillating motor 42 (as seen in FIGS. 1 and 2) honing a first side of the blade edge. The sharpening mandrel 30 is then rotated by the mandrel rotation motor 38 to angularly position the second sharpening pad 40*b* on an opposite contact plane with the blade. The sharpening mandrel 30 is then reciprocated laterally along the blade edge by the oscillating motor 42 honing a second side of the blade edge. Adjustment of the extended length of the blade between the honing of the two sides of the edge may be accomplished, if required, by the drive motor 82 turning rotating engagement post 80 and attached screw 74 as directed by the controller based on the blade location detected by the proximity sensor positioning system.

Upon completion of the sharpening process, the drive motor 82 turns the rotating engagement post 80 and screw 74 to retract the blade. The drive motor 28 may be a stepper motor or similar precision motor allowing precise control by the controller for the retracted length to accommodate the overall length reduction in the blade due to the sharpening procedure. The controller then moves the translation armature 84 with translation motor 86 upward to return the razor to the initial position for extraction from the case.

Figure 8A:
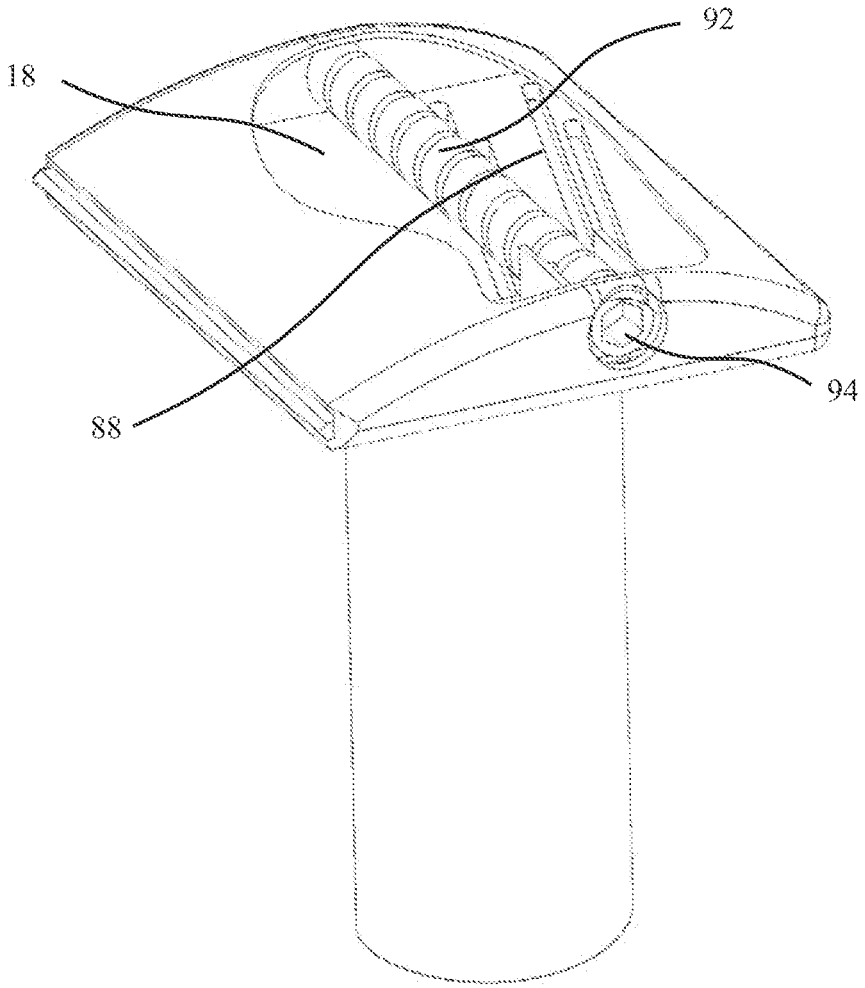
FIG. 8A is a top partial section perspective view of a third embodiment of the razor with the blade in a retracted position.
Figure 8B:
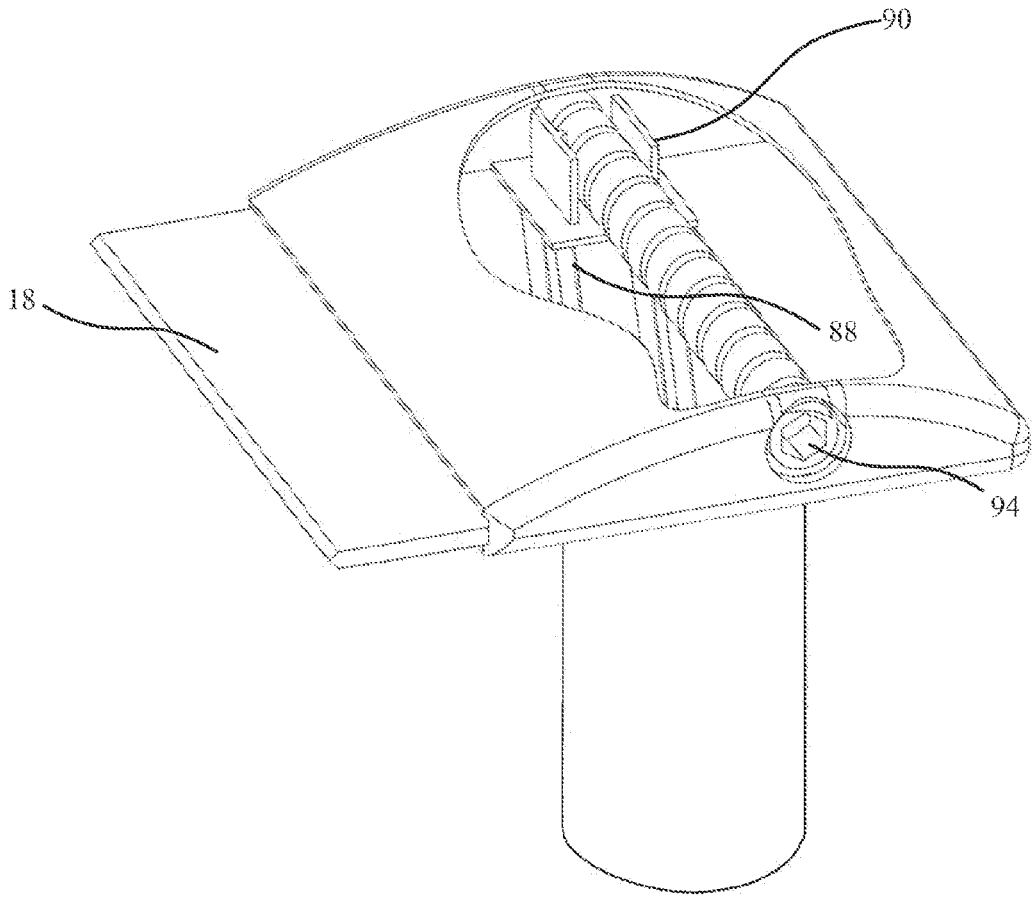
FIG. 8B is a top partial section perspective view of a third embodiment of the razor with the blade in an extended position.

A third exemplary embodiment of the razor 10 is shown in FIGS. 8A and 8B. As with the first and second embodiments, the blade 18 is extendably retained with a safety housing 16. Similar to the second embodiment, the blade 18 incorporates angled tracks 88 which are engaged by pins extending from a tracking dolly 90 carried on a jack screw 92. The jack screw 92 incorporates a hex bore 94. Rotation of the screw drives the tracking dolly along the screw laterally within the safety housing from a retracted position as shown in FIG. 8A, extending the blade from the housing as the tracking dolly drives the angled tracks as shown in FIG. 8B. An engagement recess 96 is provided in the handle 14 of the razor.

Figure 9A:
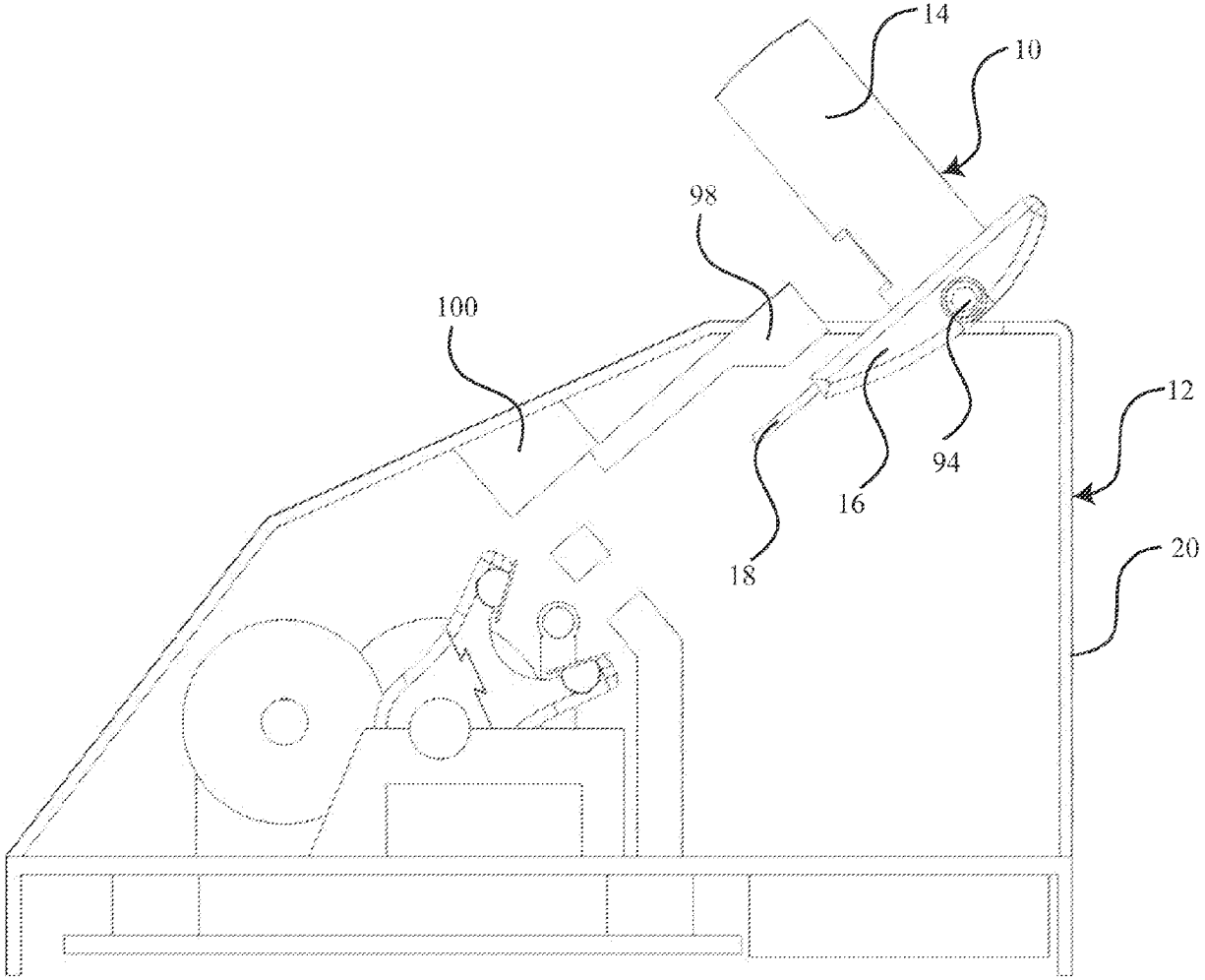
FIG. 9A is a perspective partial section side view of a third embodiment of the integrated sharpening system for use with the razor of FIGS. 8A and 8B.
Figure 9B:
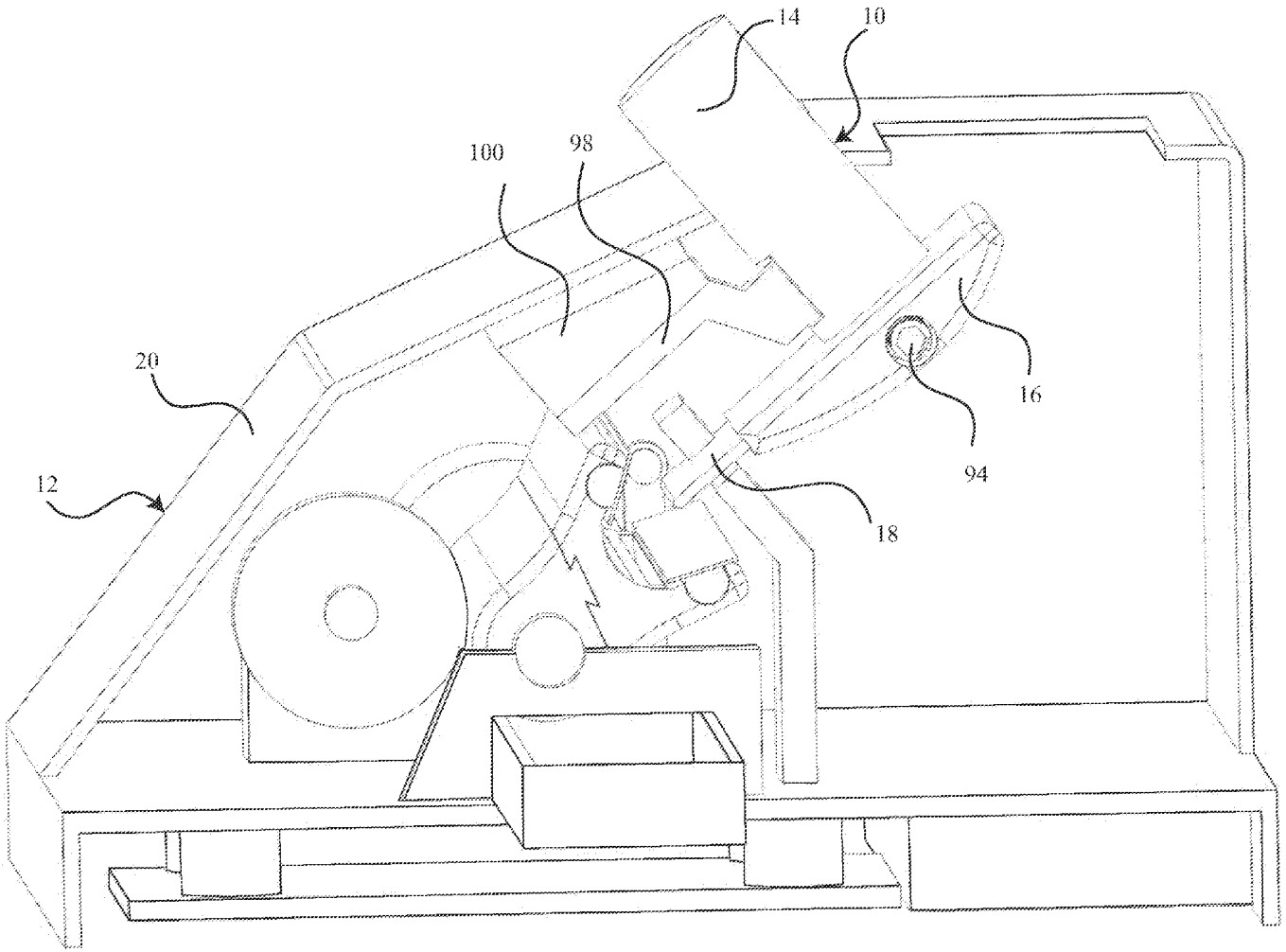
FIG. 9B is a perspective partial section view of the embodiment of FIG. 9A with the razor moved into the sharpening position and the blade extended; and, FIG. 9C is a top view of the embodiment of FIG. 9A.
Figure 9C:
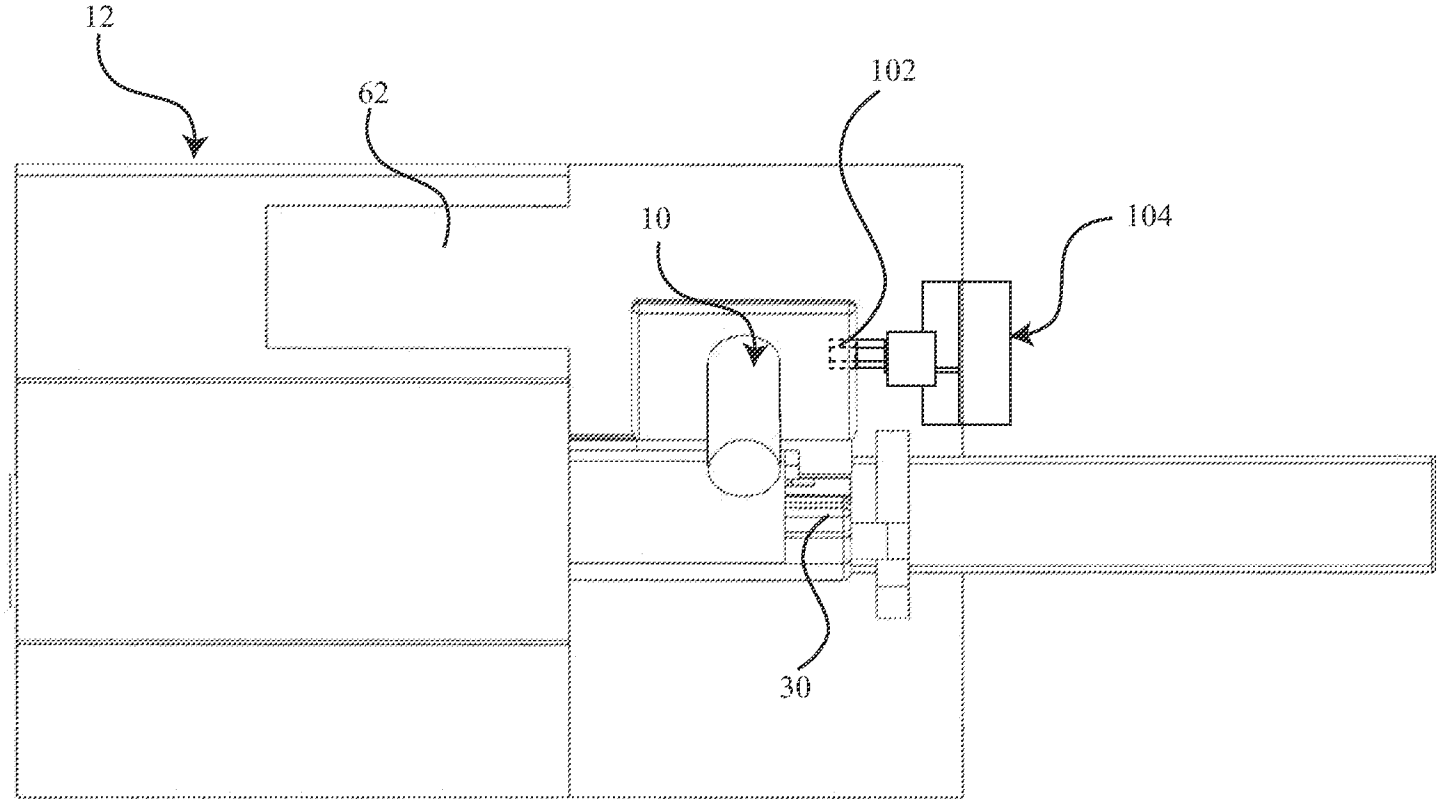

A third exemplary embodiment of integrated sharpening system 20 to accommodate the razor third embodiment is shown in FIGS. 9A, 9B and 9C with components in common with FIGS. 1-3C again carrying the same element numbers. The razor 10 is inserted into the aperture 62 in case 20 and engagement recess 96 is removably attached to a translation armature 98. A translating motor 100 moves the translation armature to position the razor in the case 20 as shown in FIG. 9B. As shown in FIG. 9C, a rotating engagement post 102 (shown in hidden line) is received within the hex bore 94 which may incorporate a spring loaded detent ball to be received within a detent in the hex bore to secure the razor into the case. A drive motor 104 with appropriate drive train turns the rotating engagement post 102. While not shown in FIGS. 9A-9C, the RFID reader and electromagnetic polarization system as described with respect to FIGS. 1 and 2 may be employed in the third embodiment.

Operation of the third embodiment is substantially similar to the operation of the second embodiment with positioning of the safety housing within the case by the translating motor 100 and extension and retraction of the blade with the drive motor 104.

Having now described various embodiments of the disclosure in detail as required by the patent statutes, those skilled in the art will recognize modifications and substitutions to the specific embodiments disclosed herein. Such modifications are within the scope and intent of the present disclosure as defined in the following claims.

What is claimed is:

1. A shaving system comprising:

a razor having a handle and a safety housing;

a blade extendably received within the safety housing;

an automated integrated sharpening system having an armature receiving the razor, said armature movable from a first position for attachment and extraction of the razor and a second position for sharpening of the blade;

a sharpening mandrel with a first sharpening surface for sharpening a first side of the blade and a second surface for sharpening of a second side of the blade, said sharpening mandrel rotatable from a first position for engagement of the first sharpening surface to a second position for engagement of the second sharpening surface, and said sharpening mandrel laterally oscillating for sharpening of the blade; and, a controller for positioning of the armature and sharpening mandrel.

2. The shaving system as defined in claim 1 further comprising a mandrel rotation motor engaging the mandrel for rotation from the first position to the second position and from the second position to the first position.

3. The shaving system as defined in claim 1 further comprising an oscillating motor for lateral oscillation of the sharpening mandrel.

4. The shaving system as defined in claim 1 further comprising a translation motor for positioning of the armature at the first and second positions.

5. The shaving system as defined in claim 4 wherein the sharpening mandrel is carried by a mandrel support, said mandrel support received on a saddle for rotation about a longitudinal axis, said mandrel support engaging a mandrel rotation motor for rotation from the first position to the second position and from the second position to the first position, said mandrel support further engaging an oscillating motor for lateral oscillation along the longitudinal axis.

6. The shaving system as defined in claim 5 wherein the integrated sharpening system further comprises a case having an aperture to receive the razor, said case housing the armature and translation motor, the saddle carrying the mandrel and mandrel support, the mandrel rotation motor and the oscillating motor.

7. The shaving system as defined in claim 5 further comprising an ultraviolet lighting system mounted in the case adjacent the sharpening mandrel for elimination of microbial contaminants on the razor safety housing and blade.

8. The shaving system as defined in claim 5 further comprising an electromagnet mounted in the case adjacent the sharpening mandrel for alignment of metal ions in a plane of a shaving edge of the blade.

9. The shaving system as defined in claim 5 further comprising a RFID reader mounted in the case for detection of a RFID chip on the razor.

10. The shaving system as defined in claim 1 wherein the razor safety housing incorporates resilient back elements and a front plate frictionally engaging the blade and the integrated sharpening system further includes an engagement post extending from the armature to receive and constrain the blade in the razor safety housing and engagement arms received through slots in the front plate urging the resilient back element away from the rear surface of the blade thereby releasing the frictional engagement of the blade in the housing, and wherein movement of the armature from the first position to the second position extends the blade from the razor safety housing for engagement by the sharpening mandrel.

11. The shaving system as defined in claim 1 wherein the razor safety housing incorporates a screw engaging a tracking dolly mounted to the blade, said screw rotatable for positioning the dolly and blade from a first retracted position to a second extended position and the integrated sharpening system further includes an engagement post extending from the armature and engaging the screw, and, a drive motor attached to the engagement post for reversible rotation.

12. The shaving system as defined in claim 1 wherein the razor safety housing incorporates a screw engaging a tracking dolly received in angled slots on the blade, said screw rotatable for positioning the tracking dolly laterally in operable engagement with the angled slots to move the blade from a first retracted position to a second extended position and from the second extended position to the first retracted position, and wherein the razor handle is removably attached to the armature;

the integrated sharpening system further including an engagement post engaging the screw, and, a drive motor attached to the engagement post for reversible rotation.

13. A method for sharpening a razor comprising:

engaging a razor having a blade extendibly mounted in a safety housing in an integrated sharpening system;

extending the blade;

rotating a sharpening mandrel to a first position for engagement of a first side of the blade;

oscillating the sharpening mandrel;

rotating the sharpening mandrel to a second position for engagement of a second side of the blade;

oscillating the sharpening mandrel;

retracting the blade; and, disengaging the razor from the integrated sharpening system.

14. The method of claim 13 wherein the step of extending the blade comprises:

engaging the blade on an engagement post extending from an armature;

urging resilient back supports away from the blade to frictionally disengage the blade from a front plate; and, translating the armature to extend the blade.

15. The method of claim 13 wherein the step of extending the blade comprises:

engaging a screw operable connected to the blade with a rotatable engagement post;

positioning the safety housing with an armature; and, rotating the engagement post for extension of the blade.

16. The method of claim 13 wherein the step of extending the blade includes calculating the blade extension for spaced contact placement of sharpening pads on the mandrel against the blade and the steps of rotating the sharpening mandrel includes calculating an angle of rotation for spaced contact placement of the sharpening pads.

* * * * *